US006302195B1

(12) United States Patent
Kataoka

(10) Patent No.: US 6,302,195 B1
(45) Date of Patent: Oct. 16, 2001

(54) HEAT EXCHANGER

(75) Inventor: Takayoshi Kataoka, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/503,717

(22) Filed: Feb. 14, 2000

(30) Foreign Application Priority Data

Feb. 15, 1999 (JP) ..... 11-036054

(51) Int. Cl.[7] ..... F28F 1/02
(52) U.S. Cl. ..... 165/134.1; 165/177; 165/183
(58) Field of Search ..... 165/134.1, 177, 165/183

(56) References Cited

U.S. PATENT DOCUMENTS 2,902,264 * 9/1959 Schick et al. ..... 165/134.1
3,190,352 * 6/1965 Simplelaar ..... 165/134.1
5,236,045 * 8/1993 Janezich et al. ..... 165/183
5,555,729 * 9/1996 Momose et al. ..... 165/183 X
6,000,467 * 12/1999 Tokizaki et al. ..... 165/134.1

FOREIGN PATENT DOCUMENTS 1-217195 * 8/1989 (JP) ..... 165/134.1
2-126097 * 5/1990 (JP) ..... 165/177

* cited by examiner

*Primary Examiner*—Leonard Leo
(74) *Attorney, Agent, or Firm*—McDermott, Will & Emery

(57) ABSTRACT

A heat exchanger according to the present invention has tube capable of flowing a fluid through interiors of the tube, a partition member provided in the tube to extend in the flowing direction of the fluid flows, a flow-through space determined by using the partition member in the tube, the fluid flowing through the interior of the flow-through space, and a non-flow-through space determined by using the partition member in the tube, the fluid being unable to flow through the interior of the non-flow-through space. Heat is exchanged between the fluid and the exterior of the tube. A portion of the tube corresponding to the non-flow-through space is mainly applied with an external action.

12 Claims, 6 Drawing Sheets

HEAT EXCHANGER

BACKGROUND OF THE INVENTION

The present invention relates to a heat exchanger and particularly relates to a heat exchanger which can be appropriately applied to a condenser, a radiator, an oil cooler or the like to be installed in a vehicle.

An example of a heat exchanger applied for a vehicle may be one applied to a condenser of an air conditioner as shown in FIG. 8. It is noted that reference symbol R denotes the right side of the vehicle, L denotes the left side thereof and UPR denotes the upper side thereof in FIG. 8.

The condenser as shown in FIG. 8 is installed, for example, crosswise in the front portion of the vehicle. The condenser is provided with right and left header pipes 101, a plurality of tubes 102 coupled to both the right and left header pipes 101 and fins 103 arranged between the tubes 102, respectively.

When a refrigerant fed from a compressor (not shown) of the air conditioner flows through the tubes 102, heat is exchanged between the refrigerant and the air passing through the fins 103, thereby cooling the refrigerant and cooling a car cabin or the like.

SUMMARY OF THE INVENTION

According to more detailed studies done by the inventor of the present invention, each tube of the condenser shown in FIG. 8 may have a sectional construction as shown in FIG. 9 or 10. It is noted that reference symbol FR denotes a front side of the vehicle and UPR denotes an upper side thereof in FIGS. 9 and 10.

In FIG. 9, a tube 202 is formed by use of an aluminum material and extrusion process. In the tube 202, a plurality of refrigerant channels 202*a* parallelly aligned in the longitudinal direction of the vehicle are formed. The refrigerant channels 202*a* of this type are designed to flow a refrigerant therethrough. The reason for providing a plurality of channels 202*a* is to increase the contact area between the refrigerant and the wall surfaces of the channels, i.e., to increase a radiating area to thereby increase heat exchange efficiency.

Meanwhile, in FIG. 10, an inner fin type tube 202' is shown. A tube main body 221 is formed by folding a metal plate and an inner fin 222 is inserted into the main body 221. The interior of the tube main body 221 is provided with a plurality of refrigerant channels 202*a*' defined by the inner fin 222 and these refrigerant channels 202*a*' are designed to flow a refrigerant therethrough.

In case of the above-stated inner fin type tube, the tube main body and the inner fin can be made thin compared with the extruded tube. Thus, the inner fine type tube is advantageously light weight while maintaining the same radiating area, and air and pressure tightness as those of the extruded tube.

With the inner fin type tube having these advantages, however, it is true that its toughness should be taken into consideration because of the thinner tube main body or the like.

For example, the condenser may be arranged at the lower front portion of the vehicle in view of the layout efficiency of the vehicle components, condenser characteristics or the like. In that case, however, a foreign matter such as a pebble bounced on the road and flew up therefrom is collided against the tube main body 221 as shown by an arrow in FIG. 10.

If the foreign matter is collided against the tube main body 221 as stated above, i.e., the tube main body 221 is applied with an external action such as an external force, the tube main body 221, the inner fin 222 and the channels 202*a*' may possibly be deformed or the like, which are by no means preferable for heat exchange function.

To avoid such disadvantages, the coupled portion 221*a* of the tube main body 221, which is a relatively tough portion, may be arranged in the front side of the vehicle against which the foreign matter tends to be collided, however, the strength of the main body 221 to be able to attain in practicable has its limit. In the meantime, the plate thickness of the tube main body 221 or the like can be simply and uniformly increased. If so, however, even a part of the plate thickness of the tube main body 221 positioned at the rear and the upper front portion of the vehicle or the like, which do not inherently need to increase its strength, is increased. As a result, not only the weight of the condenser increase but also the heat exchange characteristics thereof deteriorates. Thus, this is not an advisable countermeasure.

The present invention has been made as a result of the above-stated studies. It is, therefore, an object of the present invention to provide a heat exchanger capable of removing the influence of an external action such as the application of an external force and capable of exhibiting sufficient heat exchange characteristics while satisfying the demand for providing a condenser lighter in weight.

A heat exchanger according to the present invention is provided with a tube capable of flowing a fluid through interior of the tube; a partition member provided in the tube to extend in the flowing direction along which the fluid flows; a flow-through space determined by use of the partition member in the tube, the fluid flowing through the interior of the flow-through space; and a non-flow-through space determined by use of the partition member in the tube, the fluid being unable to flow through the interior of the non-flow-through space. Heat is exchanged between the fluid and the exterior of the tube. A portion of the tube corresponding to the non-flow-through space is mainly applied with an external action.

In other words, a heat exchanger according to the present invention is provided with a fluid channel capable of flowing a fluid flow through the interior of the channel; partition means for partitioning the fluid channel; a flow-through section determined by use of the partition means in the fluid channel, the fluid being allowed to flow through the interior of the flow-through section; and a non-flow-through section determined by use of the partition means in the fluid channel, the fluid being unable to flow through the interior of the non-flow-through section.

DESCRIPTION OF THE PREFERRED EMBODIMENTS

Now, the embodiments of the present invention will be described in detail, while appropriately referring to the accompanying drawings.

First, a heat exchanger in the first embodiment according to the present invention will be described with reference to FIGS. 1 to 5, taking a condenser C of an air conditioner for a vehicle V as an example.

In FIGS. 1 to 5, reference symbol FR denotes the front side of the vehicle V, L denotes the left side thereof, R denotes the right side thereof and UPR denotes the upper side thereof.

Figure 1:
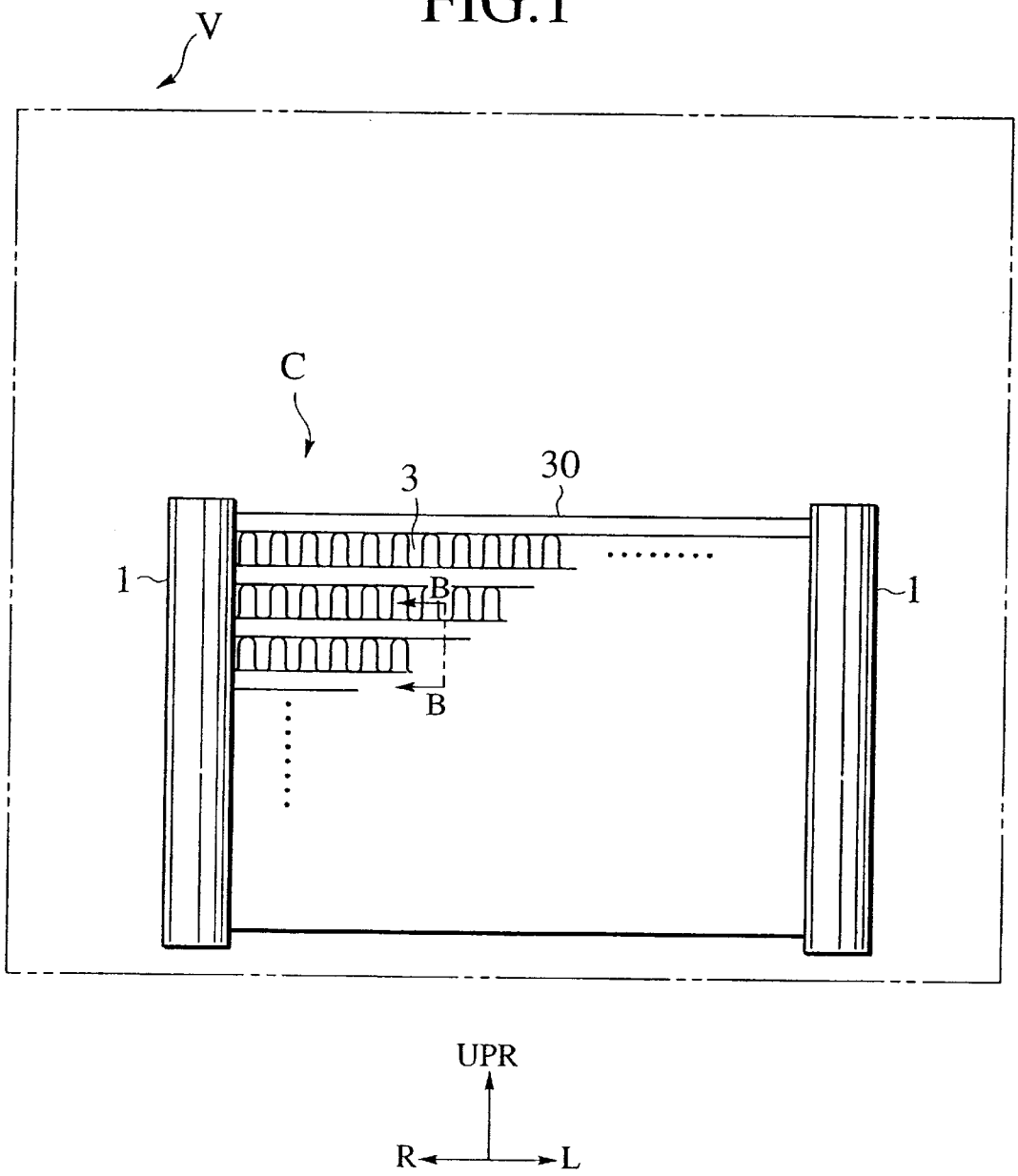
FIG. 1 is a view showing a condenser serving as a heat exchanger in accordance with a first embodiment of the present invention, seen from the front side of a vehicle.

As shown in FIG. 1, the condenser C in this embodiment is installed crosswise in the front portion of the vehicle V. The condenser C is provided with right and left header pipes 1, a plurality of tubes 2 coupled to the right and left header pipes 1 and fins 3 arranged between the tubes 2, respectively.

When a refrigerant fed from a compressor, which is not shown therein, flows through the tubes 2, heat is exchanged between the refrigerant and the air passing through the tubes 2 to thereby cool a car cabin.

Figure 2:
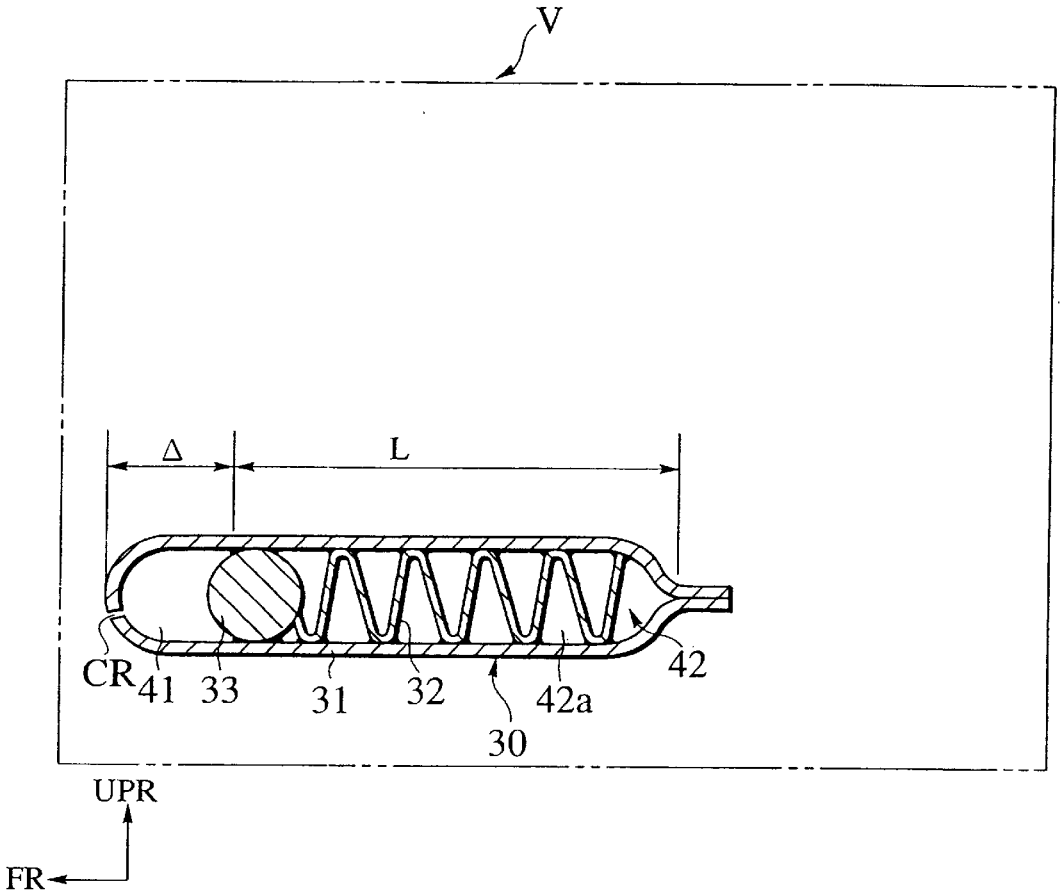
FIG. 2 is a cross-sectional view of a tube taken along line B—B of FIG. 1.
Figure 3:
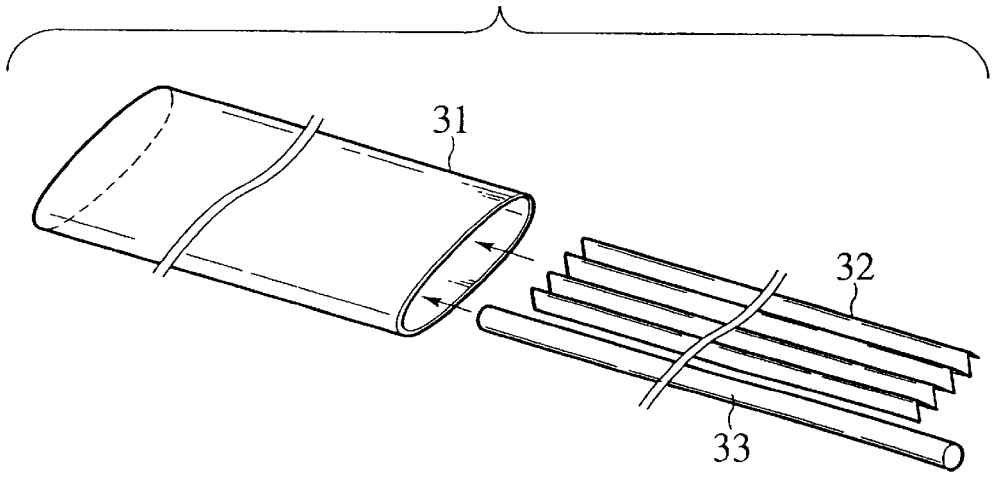
FIG. 3 is a perspective view showing assembly steps of the tube of the condenser in accordance with the embodiment.

A tube main body 31 is constituted by folding an aluminum plate as shown in FIG. 2. The depth (length in the longitudinal direction of the vehicle) is set larger than a conventional length L by Δ. As shown in FIG. 3, an inner fin 32 is inserted into a tube main body 31 in the width direction of the tube and a round bar-shaped partition bar 33 (corresponding to a partition member) made of aluminum is inserted thereinto in the same direction. The partition bar 33 partitions a space within the tube main body 31 into a vehicle front side space 41 (corresponding to a non-flow-through space) and a vehicle rear side space 42 (corresponding to a flow-through space). The diameter of the partition bar 33 is set sufficiently larger than the plate thickness of the tube main body 31. The inner fin 32 is inserted into the rear side space 42, whereby the rear side space 42 is further divided into a plurality of coolant channels 42*a*.

Figure 4:
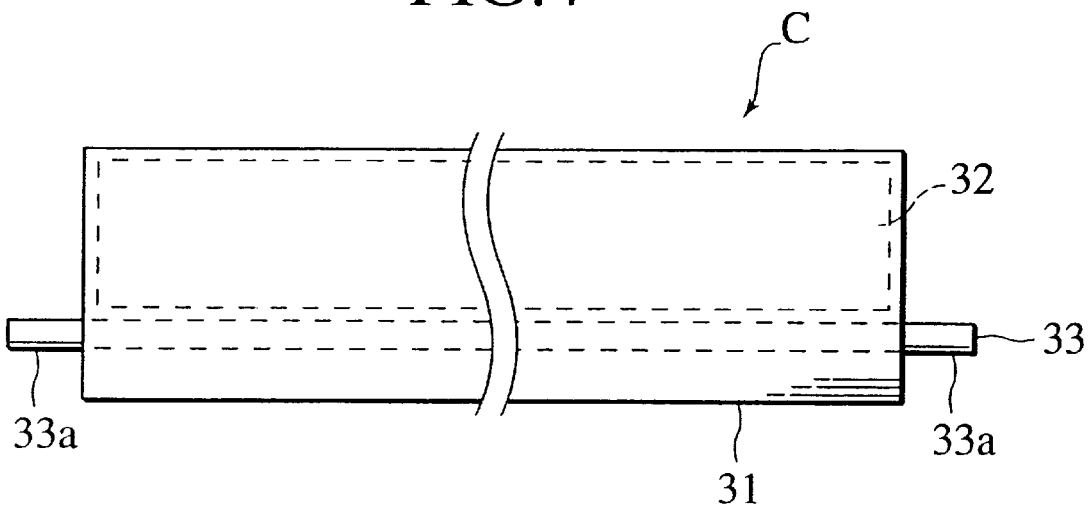
FIG. 4 is a view showing the tube of the condenser in accordance with the embodiment, seen from the upper side of the vehicle.

The length of the partition bar 33 is set larger than the width of the tube main body 31. As shown in FIG. 4, the partition bar 33 is inserted into the tube main body 31 so that the both ends of the bar 33 protrude from the both ends of the tube main body 31 by tube positioning portions 33*a*, respectively. The surface of the partition bar 33 is coated with a clad material containing a brazing filler material as in the case of the inner fin 32. When the tube 30 is inserted into a furnace to carry out brazing, the upper and lower convex portions of the inner fin 32 and, at the same time, the upper and lower portions of the partition bar 33 are brazed to the inner wall of the tube main body 31. Thus, even if the partition bar is added, it is ensured that the inner fin is bonded to the tube main body 31 without increasing the number of brazing steps.

Next, procedures for incorporating the tubes 30 into the condenser will be described.

Figure 5:
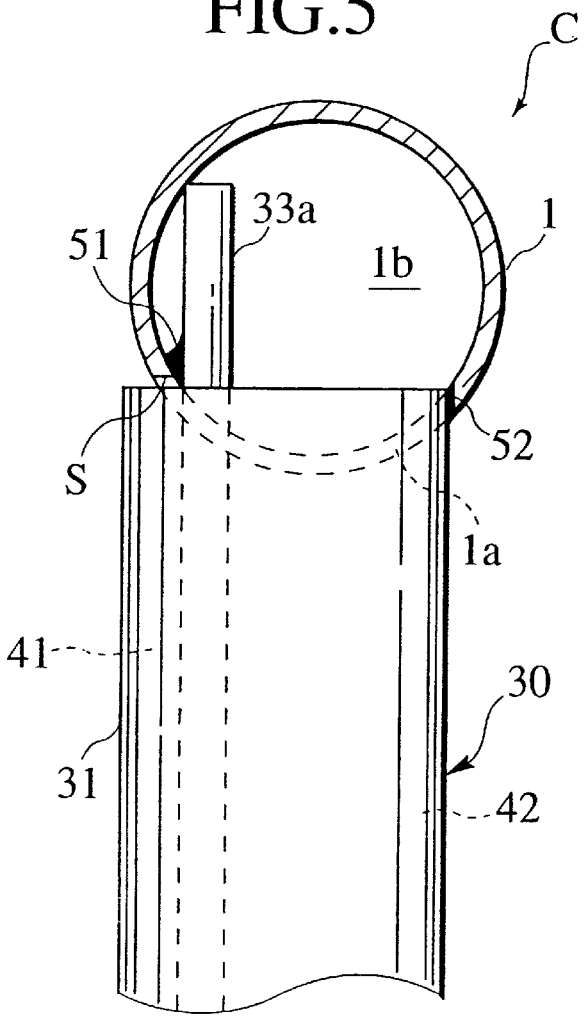
FIG. 5 is a partially cross-sectional view showing the connection structure between the tube and the header pipe of the condenser in accordance with the embodiment, seen from the upper side of the vehicle.

As shown in FIG. 5, a plurality of notches 1*a* for coupling the tubes are formed on the right and left header pipes 1 of the condenser C in advance. One end of each tube 30 is engaged with its corresponding notch 1*a* and the tube positioning portion 33*a* is abutted against the inner wall of the header pipe 1 for positioning purposes. The same operation is performed for the right and the left header pipes 1. Next, when brazing is conducted in the furnace, portions denoted by reference numbers 51 and 52 shown in FIG. 5, the upper and lower surfaces of the notches 1*a* and the outer surface of the tube main body 31 are continuously brazed together, thereby fixing the tube 30 to the header pipe 1. At this moment, the rear side space 42 of the tube main body 31 is communicated with a space 1b within the header pipe 1, whereas the front side space 41 is not communicated with the space 1*b* within the header pipe 1. Although a gap may possibly be formed between the end portion of the tube 30 and the wall surfaces of the notches 1*a* due to the dimensional tolerance of the partition bar 33 or the like, the leakage of the refrigerant within the space 1*b* from the gap S to the outside can be effectively prevented by brazing the portion denoted by reference number 51.

In the condenser C in this embodiment constituted as stated above, the refrigerant forcedly fed by a compressor, which is not shown, flows from the space 1*b* of the header pipe 1 into the rear side space 42 of the tube 30 and heat is exchanged between the refrigerant flowing through the rear side space 42 and the air passing through the fin 3 to thereby cool the refrigerant. As already stated above, since the front side space 41 is not communicated with the tube main body 31, the refrigerant does not flow into the front side space 41. In this way, although the tube main body 31 has a space through which a refrigerant does not flow, the rear side space 42 has the same width L as that in the conventional case and heat exchange efficiency is not inferior to that in the conventional case.

While the vehicle is travelling, an object such as a pebble may be let fly toward the vehicle and collided against the front side of the tube main body 31. Since the refrigerant flows through the front side space 41 of the tube 31, even if a crack CR or a hole is made on the front side portion of the tube main body 31, it is possible to effectively prevent the refrigerant from leaking outside due to the collision of the pebble. In some cases, the pebble or the like may penetrate the tube main body 31 and collide against the partition bar 33. If so, however, the impetus of the pebble goes down because of its collision against the tube main body 31. Besides, since the partition bar 33 has a diameter sufficiently larger than that of the tube main body 31, cracking is effectively prevented even if the pebble is collided against the partition bar 33 and leakage of the refrigerant is thereby effectively avoided.

As stated above, in this embodiment, since the space 41 through which the refrigerant does not flow is provided in the front side portion of the tube 30, it is possible to surely prevent leakage of the refrigerant without increasing the plate thickness of the tube main body 31, i.e., without increasing the weight and hampering the radiation performance of the heat exchanger or condenser. Particularly, due to the partition bar 33 formed out of a round bar, it is possible to constantly secure an enough brazing area even if the position of the partition bar 33 is rotated relative to the tube main body 31. Thus, the air tightness of the heat exchanger does not deteriorate. Meanwhile, it is noted that a square partition bar may be used instead of the round bar. In that case, if the partition bar is arranged so that the square portion of the bar is abutted against the inner wall of the tube main body 31, the brazing area in which the bar is brazed to the inner wall may be decreased and enough air tightness may not be maintained. Considering this, it is possible to add a clad material if required. In addition, as shown in FIG. 5, the protruding portions on the both ends of the partition bar 33 are used for positioning the bar 33 relative to the header pipes 1. Due to this, it is possible to dispense with a side plate for coupling the upper and lower ends of the right and left header pipes as conventionally used and to thereby reduce the number of components.

Next, description will be given to a heat exchanger in a second embodiment according to the present invention.

The heat exchanger in the second embodiment has basically the same construction as that of the heat exchanger in the first embodiment and can be applied to a condenser of an air conditioner for a vehicle V as in the case of the first embodiment. The heat exchanger in this embodiment differs from that in the first embodiment in the construction of a fin arranged within a tube. It is noted that the same constituent elements of the heat exchanger in this embodiment as those in the first embodiment are denoted by the same reference symbols and that description will not be, therefore, given to the specific construction thereof.

Figure 6:
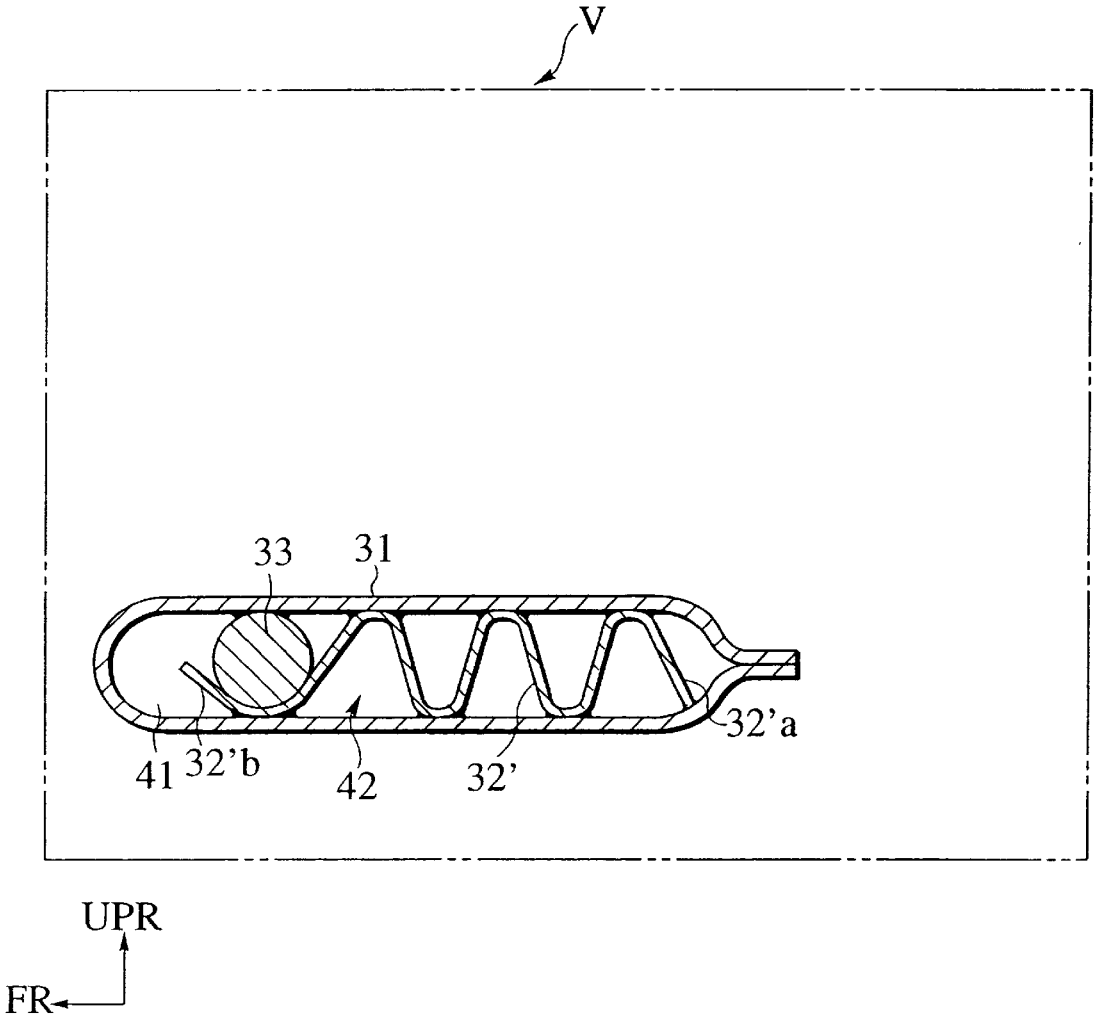
FIG. 6 is a cross-sectional view of a tube, corresponding to FIG. 2, in accordance with a second embodiment in the present invention.

Specifically, as shown in FIG. 6, an inner fin 32' inserted into a tube main body 31 in the width direction of the tube (direction in which a refrigerant flows through) has a fin shape continuing between one end portion 32'*a* and the other end portion 32'*b* as in the case of the first embodiment. Differently from the first embodiment, the fin shape is matched to the shape of a partition member 33.

With this construction, when the inner fin 32' is inserted into the tube main body 31, one end portion 32*a'* of the inner fin 32' is engaged with the inner wall of the tube main body 31 positioned right in FIG. 6 and the respective vertex portions of the fin shape are also engaged with the inner wall thereof. The inner fin 32' is thereby inserted into the tube main body 31 while being surely guided and finally placed at a position set relative to the tube main body 31.

Next, when the partition member 33 is inserted into the tube main body 31, it contacts with the curved portion of the fin shape positioned at the other end portion 32'*b* and guided surely. Finally, the partition member 33 is placed at a position set relative to the tube main body 31.

Thereafter, the right and left header pipes 1 having the tube main body 31 into which the inner fin 32 and the partition member 33 are inserted to be arranged at set positions, respectively, are put in a furnace and brazing is conducted as in the case of the first embodiment and the tube 31 is eventually completed.

As stated above, in this embodiment, the partition member 33 is inserted into the tube main body 31 while being positioned using the curved portion of the fin shape of the inner fin 32'. This makes it possible to efficiently and accurately install the partition member 33 into the tube main body 31 without the need to provide a dedicated positioning member.

Next, description will be given to a heat exchanger in a third embodiment according to the present invention.

The heat exchanger in the third embodiment, like that in the second embodiment, has basically the same constitution as that in the first embodiment and can be applied to a condenser of an air conditioner for a vehicle V, as well. The heat exchanger in this embodiment differs from that in the first embodiment in the construction of a partition bar arranged in a tube. It is noted that the same constituent elements of the heat exchanger in this embodiment as those in the first embodiment are denoted by the same reference symbols and that description will not be, therefore, given to the specific constitution thereof.

Figure 7:
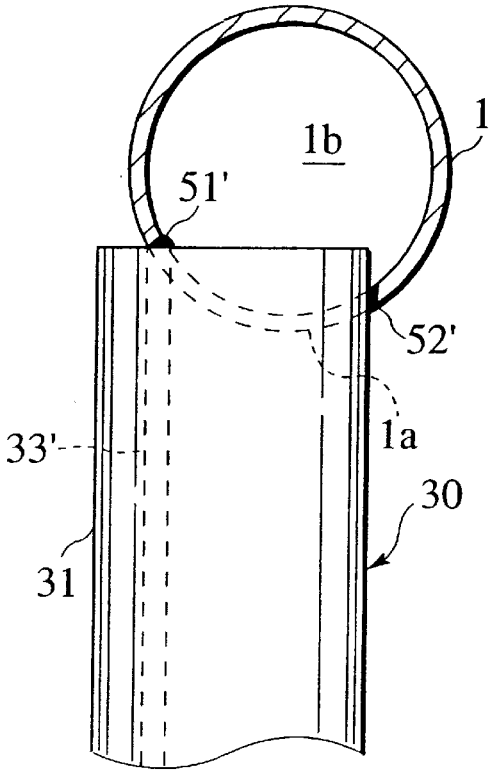
FIG. 7 is a partially cross-sectional view showing the connection structure, corresponding to FIG. 5, in accordance with a third embodiment in the present invention.
Figure 8:
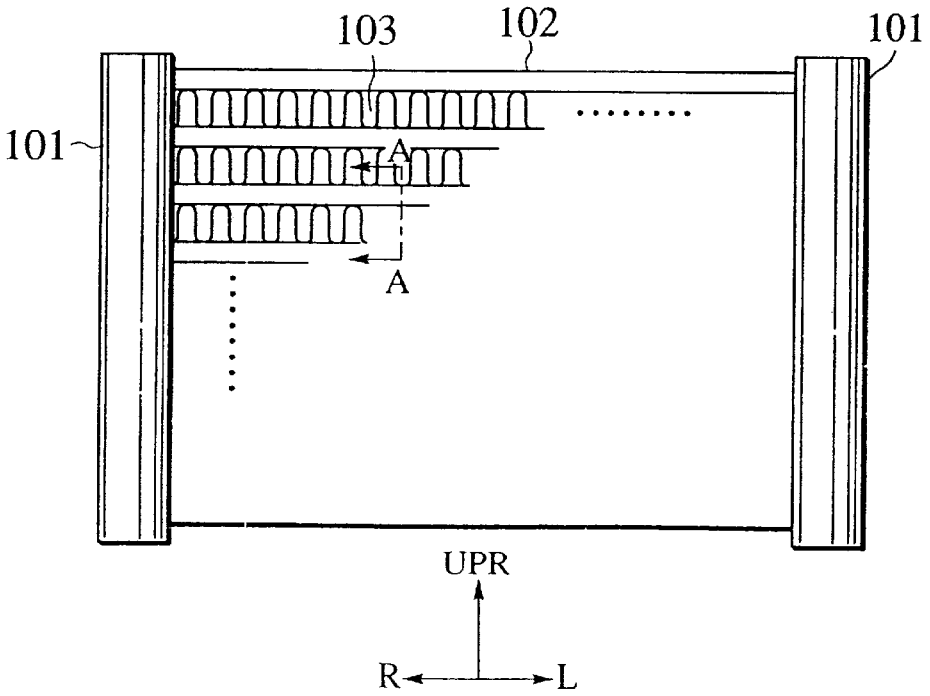
FIG.8 PRIOR ART
FIG. 8 is a view showing a condenser serving as a general heat exchanger, seen from the front side of a vehicle.
Figure 9:
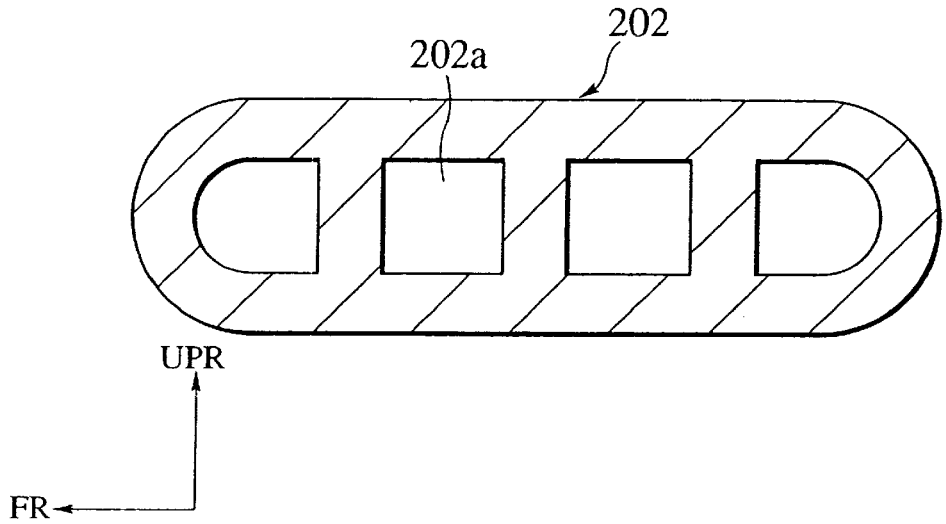
FIG.9 (PRIOR ART)
FIG. 9 is a cross-sectional view of a tube taken along line A—A of FIG. 8 according to the studies of the inventor of the present invention.
Figure 10:
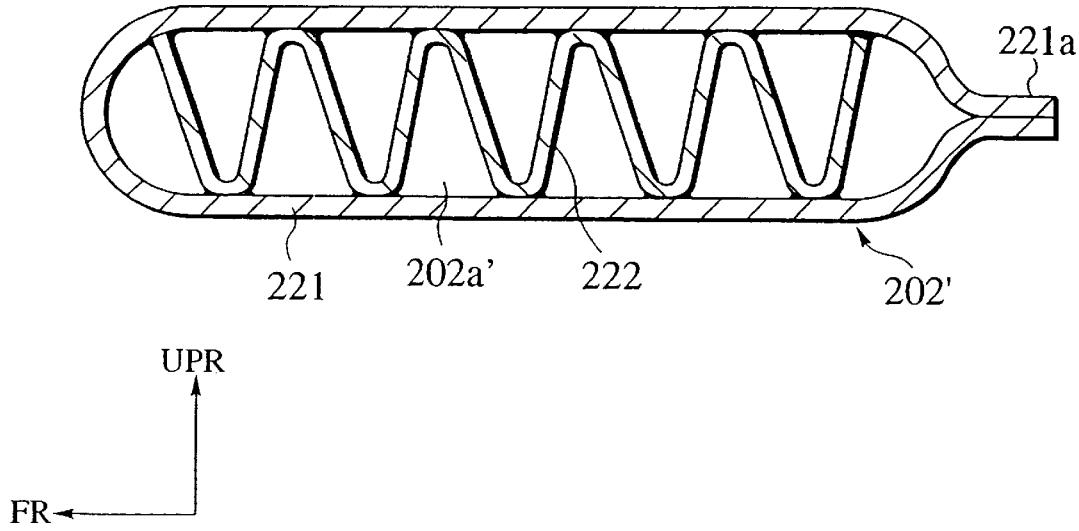
FIG.10 (PRIOR ART)
FIG. 10 is a cross-sectional view of another tube taken along line A—A of FIG. 8 according to the studies of the inventor of the present invention.

Specifically, as shown in FIG. 7, a partition bar 33' is inserted into a tube main body 31 as in the case of the first embodiment. The length of the bar 33' is the same as the width of the tube main body 31 and no protruding portions protruding from the tube main body 31 are provided.

With this construction, when each tube 30 is incorporated into right and left header pipes 1, one end of each tube 30 and, at the same time, its corresponding end of the partition bar 33' fixed to the tube 30 are engaged with their corresponding notch 1*a* of one of the header pipes 1, and then the other end of the tube 30 and, at the same time, its corresponding end of the partition bar 33' are engaged with their corresponding notch 1*a* of the other of the header pipes 1, thereby positioning the tubes 30 and the right and left header pipes 1.

Next, the right and left header pipes 1 relative to which the tubes 30 are positioned, are put in a furnace and brazing is conducted. Then, notices 1*a* such as portions denoted by 51' and 52' are bonded to each tube 30 and the tubes 30 are fixed to the header pipes 1.

As stated above, in this embodiment, the header pipes 1 are positioned without providing the partition bar 33' with additional protruding portions. This makes it possible to efficiently and sufficiently position the header pipes 1 with a simple construction.

The above-stated embodiments concern a constitution in which the interior of the tube is partitioned in the longitudinal direction of the vehicle so that a non-flow-through space is provided. It is also possible to partition the interior of the tube in the vertical direction or other directions of the vehicle since the non-flow-through space may be provided at a position toward which pebbles or the like tend to be let fly from the road.

In addition, the above-stated embodiments concern a constitution in which the interiors of all tubes are partitioned and non-flow-through spaces are provided, respectively. It goes without saying that it is also possible to partition only a specified tube or specified tubes and a non-flow-through space or spaces may be provided, as required.

Further, the heat exchangers in the above embodiments have been described while exemplifying a condenser of an air conditioner installed in a vehicle to which the present invention is applied. Needless to say, the present invention is also applicable to a radiator, an oil cooler or the like and further applicable to components other than vehicle installed components as long as it is necessary to provide a non-flow-through space therein.

Moreover, it is possible to configure a heat exchanger by combining the constitution for positioning the partition member within each tube in the second embodiment and that for positioning the tubes and the header pipes in the third embodiment, as required.

The entire contents of a Patent Application No. TOKUGANHEI 11-36054, with a filing date of Feb. 15, 1999 in Japan, are hereby incorporated by reference.

Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A heat exchanger comprising:

a tube capable of flowing a fluid through interior thereof, heat being exchanged between the fluid and an exterior of the tube;

a partition member provided in the tube to extend in a flowing direction along which the fluid flows;

a flow-through space determined by use of the partition member in the tube, the fluid flowing through an interior of the flow-through space; and a non-flow-through space determined by use of the partition member in the tube, the fluid being unable to flow through an interior of the non-flow-through space, wherein a portion of the tube corresponding to the non-flow-through space is mainly applied with an external action, and wherein a fin is inserted into the tube, and the partition member is positioned by use of a curved portion of the fin.

2. A heat exchanger according to claim 1, wherein the partition member is a bar-shaped member extending in the flowing direction of the fluid and fixed to an inner wall of the tube.

3. A heat exchanger according to claim 2, wherein the bar-shaped member is bonded to the inner wall of the tube.

4. A heat exchanger according to claim 2, wherein the bar-shaped member is a round bar member and has a diameter larger than a plate thickness of the tube.

5. A heat exchanger according to claim 1, further comprising a pair of header pipes each connected to both ends of the tube and each having a space communicated with the flow-through space of the tube.

6. A heat exchanger according to claim 5, wherein the tube is plurally provided so as to connect between the pair of header pipes.

7. A heat exchanger according to claim 5, wherein the partition member has protruding portions on both ends thereof, the protruding portions protruding from the tube, and the protruding portions functioning as a positioning member abutted against inner walls of the pair of header pipes so as to position the tube relative to the pair of header pipes.

8. A heat exchanger according to claim 5, wherein the partition member has both end portions matched with the both ends of the tube, the both end portions of the partition member functioning as a positioning member abutted against notches of the pair of header pipes so as to position the tube relative to the pair of header pipes.

9. A heat exchanger according to claim 1, wherein the heat exchanger is installed in a vehicle, and the non-flow-through space of the tube is arranged to be directed toward outside of the vehicle.

10. A heat exchanger according to claim 1, wherein a surface of the fin and a surface of the partition member are coated with a clad material containing a brazing filler material in advance.

11. A heat exchanger according to claim 1, wherein external action is resulted from collision of a foreign matter.

12. A heat exchanger comprising:

a fluid channel capable of flowing a fluid flow through an interior of the channel, heat being exchanged between the fluid and an exterior of the channel;

partition means for partitioning the fluid channel;

a flow-through section determined by use of the partition means in the fluid channel, the fluid being allowed to flow through an interior of the flow-through section; and a non-flow-through section determined by use of the partition means in the fluid channel, the fluid being unable to flow through an interior of the non-flow-through section, wherein a fin is inserted into the tube, and the partition means is positioned by use of a curved portion of the fin.

* * * * *